United States Patent [19]

Cluff et al.

[11] 4,441,739

[45] Apr. 10, 1984

[54] BOOKLET

[76] Inventors: Warren S. Cluff, 510 Topping Hill Rd.; David W. Cluff, 610 Dorian Rd., both of Westfield, N.J. 07090

[21] Appl. No.: 296,803

[22] Filed: Aug. 27, 1981

[51] Int. Cl.[3] ..... B42D 1/00

[52] U.S. Cl. ..... 281/16; 281/17; 283/81; 283/900; 283/74; 283/63 R; 283/56

[58] Field of Search ..... 281/16, 19; 283/56, 283/63 R, 74, 81, 900; 412/2

[56] References Cited

U.S. PATENT DOCUMENTS

| | | | |
|---|---|---|---|
| 2,322,647 | 6/1943 | Luce | 281/16 X |
| 3,920,267 | 11/1975 | Lyon, Jr. | 281/16 |
| 4,010,964 | 3/1977 | Schechter | 283/56 |
| 4,193,498 | 3/1980 | Rowling | 281/16 X |
| 4,312,523 | 1/1982 | Haines | 283/81 X |

*Primary Examiner*—Paul A. Bell

*Attorney, Agent, or Firm*—Kenyon & Kenyon

[57] ABSTRACT

A booklet containing a multiplicity of multi-page pamphlets is affixed to a bulk container for prescription drugs. Each pamphlet can be removed from the booklet for dispensing with a filled prescription. Each pamphlet serves as a patient package insert. The booklet may also contain a professional insert which is removable in a similar fashion.

9 Claims, 6 Drawing Figures

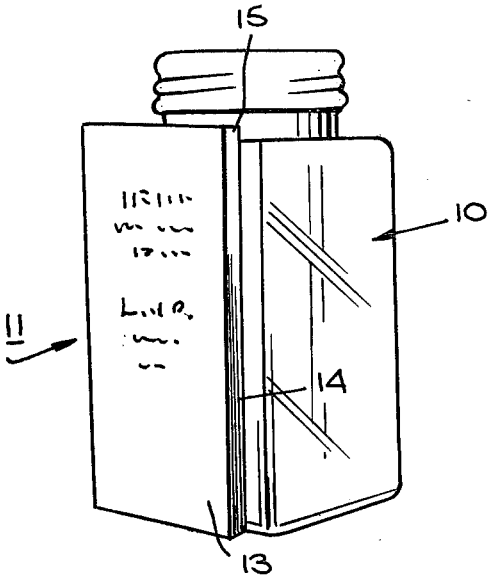
Fig. 1.
Fig. 2.
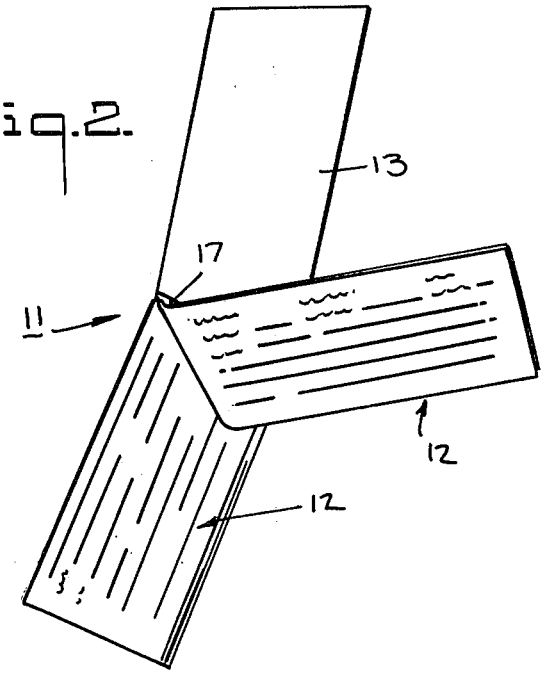
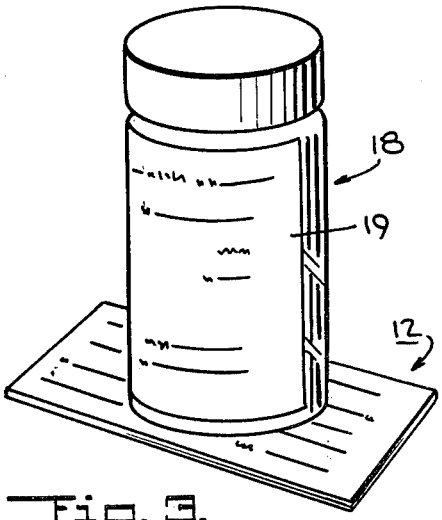
Fig. 3.
Fig. 4.
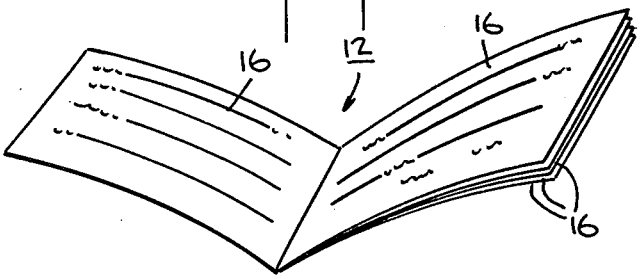
Fig. 5.
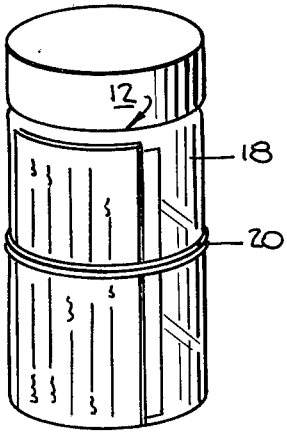
Fig. 6.
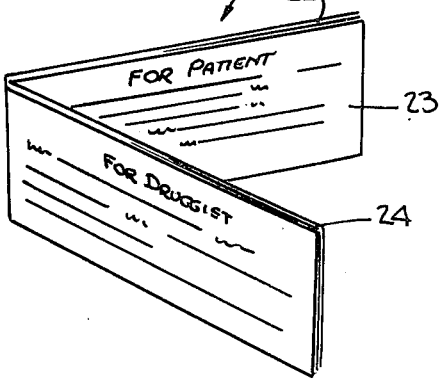

BOOKLET

This invention relates to a booklet. More particularly, this invention relates to a booklet for attachment to a bulk container for prescription drugs.

As is known, it has been the custon by regulation for pharmaceutical manufacturers to furnish a professional information insert or outsert with bulk packages of prescription drugs. The purpose for this is to insure that the pharmacist and/or doctors have the necessary technical information to properly instruct patients and anwer patients' questions with respect to drugs that have been prescribed. In many cases, because pills and the pill bottles are small, it has been the custom to print this information on a single sheet of paper and to have the paper folded several times to produce a small insert which can be inserted into the top of the bottle, affixed to the side of the bottle or placed in a box with a bottle of pills. Generally, this has been done by machine or by hand depending upon the relative size and/or quantity being manufactured. If carried out manually, such requires a high degree of labor.

In recent years, proposals have been made to pass legislation to require not only professional inserts but also patient information leaflets or inserts which a pharmacist can dispense with each prescription which is filled. The purpose would be to inform the ultimate user, i.e. the patient, of any side effects to expect and what to do about certain danger signals. In some cases, the pharmaceutical manufacturers who have followed such regulations have furnished a pad of patient package inserts (PPI) to the pharmacist to dispense individually with each prescription. In some cases, the manufacturers have furnished folded patient package inserts somewhat the same as the professional inserts or outserts noted above. Because of the voluminious amount of verbiage required per patient package insert, the normal packaging for these folded inserts was via a box. In such cases, the box would contain an interior section for a small bottle of pills and a larger interior section for the multi folded inserts required.

In order cases, suggestions have been made to provide pads of patient package inserts shipped independently of a bulk package container. However, this presents a serious storage problem for a pharmacist. Other suggestions include the use of folded patient package inserts which are pasted to each other and affixed to a bottle, or the use of folded patient package inserts in a box with a bottle. In other cases, a suggestion has been made to use a chipboard box which is affixed to a bottle with folded patient package inserts inside.

However, the various types of vehicles for providing the patient with information have been relatively bulky and cumbersome to use.

Accordingly, it is an object of the invention to provide a patient package insert which can be easily untilized.

It is another object of the invention to provide a patient package insert which can be readily dispensed by a pharmacist.

It is another object of the invention to provide a patient package insert booklet which can be readily manufactured and shipped by a pharmaceutical manufacturer to various pharmacies with a bulk container of drugs.

Briefly, the invention provides a booklet for attachment to a bulk container for prescription drugs. This booklet comprises a plurality of removable multi-page pamphlets at least some of which contain identical patient information for dispensing as a patient package insert (PPI).

In addition, at least one of the pamphlets may be made with a different visual characteristic from the remainder of the pamphlets in order to define a professional insert, for example for a pharmacist, while the remainder define patient package inserts. In this regard, the visual characteristic may be one of color or size.

The booklet may also be constructed with a front cover and a back cover with the removable pamphlets located therebetween. In any event, the pamphlets are removably secured together at one side and the pages of each pamphlet are secured together at the opposite side. In this construction, each pamphlet forms a self-contained unit which can be removed from the booklet and dispensed with a filled prescription. To this end, the pages of each pamphlet may be perforated adjacent the side at which the pamphlets are secured together as a unit in order to permit separation of the pamphlets from the booklet.

In another embodiment, the booklet can be provided with only a back cover for securement to a bulk container.

In still another embodiment, a booklet can be constructed of a patient package insert and a professional insert, each of pamphlet form which are secured along a common side to a back cover. In this case, the back cover can be secured to a container for prescription drugs so that upon dispensing, a pharmacist can remove the professional insert leaving the patient package insert on the container.

In general, the booklet contains enough multi-page pamphlets (PPIs) for the probable number of new prescriptions in a bulk package bottle. Each time a new prescription is filled, the pharmacist would tear off one PPI from the booklet for dispensing with the prescription.

The booklets and pamphlets are made of an appropriate size so as to be affixed to the outside, side or back of a bulk package container on a drug manufacturer's production line. Various types of machines can be used to mechanically affix the booklet to a container.

In order to form a booklet, use may be made of rotary presses. In this case, the presses print the various pages on large paper rolls at high speeds. The rolls are then run through business forms collators (without any carbon) and glued together into pamphlets at high speeds to insure against mis-labeling. After the pamphlets are completed, each is cut off in approximately 12 to 15 inch lengths. The pamphlets are then brought together with a printed cover and bound in a perfect binder. Thereafter, the bound pamphlets are cut up into individual booklets, for example using a guillotine cutter.

In some cases, particularly where there is a limited number of pages, the booklets may be made without covers and the perfect binding step eliminated.

The invention thus provides a booklet which can be easily handled by a pharmacist in a drug store. Further, a pamphlet is always easily available to be referred to without the disadvantage of trying to refold a road map type piece of paper.

The invention further provides a patient package insert which can be readily read by a user in a relatively simple manner.

The booklets can be provided to a pharmaceutical manufacturer in corrugated cartons which can be loaded into an automatic outsert attaching machine if the manufacturer requires. In this case, the booklets may be attached directly to the outside of a bulk package container on a production line. This should insure that the proper information pamphlets accompany the proper product. Alternatively, the booklets can be attached to the bulk package containers manually.

These and other objects and advantages of the invention will become more apparent from the following detailed description taken in conjunction with the accompanying drawings wherein:

FIG. 1 illustrates a bulk container for a prescription drug with a booklet according to the invention affixed thereto;

FIG. 2 illustrates a booklet according to the invention;

FIG. 3 illustrates a patient package insert which has been removed from the booklet in FIG. 2 with a small bottle of drugs;

FIG. 4 illustrates a pamphlet of the booklet of FIG. 2 in an opened manner for reading;

FIG. 5 illustrates a modified form for dispensing a bottle of pills with a patient package insert; and FIG. 6 illustrates a modified booklet according to the invention.

Referring to FIG. 1, a bulk container 10 containing an amount of a prescription drug sufficient for dispensing a plurality of individual prescriptions is provided with a booklet 11 containing various inserts in the form of pamphlets. The booklet 11 is of suitable size and shape to be affixed to the container 10 in any suitable manner, for example by adhesives.

Referring to FIGS. 1 and 2, the booklet 11 is comprised of a plurality of removable multi-page pamphlets 12. At least some of the pamphlets 12 contain identical printed patient information for subsequent dispensing as a patient package insert (PPI) while one pamphlet may be provided with somewhat different printed information for use as a professional insert.

The booklet 11 also includes a front cover 13 and a back cover 14 which is secured to the bottle 10. In addition, the pamphlets 12 are bound to the covers 13, 14 along a central spine 15, for example via a layer of glue or adhesive (not shown).

As shown in FIG. 2, each pamphlet 12 is formed of a multiplicity of pages 16, for example from 8 to 16 pages or more. These pages are joined along opposite sides and are removably secured within the booklet 11 at the side adjacent the spine 15. Thus, the free ends of the pages of each pamphlet 12 are secured to each other to form a unit. In addition, each page has a perforation 17 near the side secured to the spine 15 so as to permit removal of a pamphlet 12 from the booklet 11.

Referring to FIG. 4, after a pamphlet 12 has been removed from the booklet 11, the perforated ends form the free ends of the pages of printed material. The otherwise secured end thus forms a "spine" of the pamphlet. As indicated in FIG. 4, the pamphlet can be easily opened and read.

Referring to FIG. 3, each pamphlet 12, after removal, can be dispensed with a bottle 18 of pills or other prescription drug. For example, the bottle can be placed on top of the flat PPI while awaiting customer pick-up. In this condition, a label 19 on the bottle 18 can clearly display the patient's name. Further, having the bottle placed on top of the proper PPI insures dispensing with proper prescription. Of note, a folded insert would be too bulky to lay flat under a bottle 18.

Referring to FIG. 5, when a patient stores the bottle 18, for example in a cabinet, the PPI can be neatly wrapped around the prescription bottle with an elastic band 20. The compact construction of the booklet allows for frequent reference without unweildy refolding.

Referring to FIG. 6, a booklet 21 may be made in another manner for affixing to an individual bottle of drugs. In this case, the booklet 21 includes a back cover 22 which can be affixed directly to a bottle (not shown), a pamphlet 23 forming a patient package insert and a pamphlet 24 forming a professional insert. As indicated, each of the pamphlets 23, 24 have individual pages which are secured together at only one side. In this case, the cover 22 and pamphlets 23, 24 are joined along this common side, for example via gluing or other adhesive means.

When in use, the booklet 21 can be attached to a bottle and shipped and dispensed in this condition. Upon dispensing to a consumer, the professional insert pamphlet 24 would be removed leaving only the patient package insert 23 affixed to the bottle (not shown).

The invention thus provides a booklet which can be attached to a bulk package container to provide an adequate number of patient package inserts for filling a number of prescriptions. In such a case, very little extra shelf space or storage space is required by a pharmacist.

The booklet allows the individual patient package inserts to be readily removed while holding the bulk container in one hand. In this respect, each pamphlet can be removed from the booklet by a simple tearing action.

Once removed from a booklet, a patient package insert can be readily manipulated with a filled prescription bottle. Further, upon dispensing to a consumer, a pharmacist may very quickly and easily fan through the insert to highlight important information to the customer. Thereafter, the PPI can be wrapped about the prescription bottle and secured in place with an elastic band.

Because of the booklet style, the individual pamphlets can be easily read as a magazine without an excess of information on any one page.

What is claimed is:

1. A booklet for attachment to a bulk container for prescription drugs, said booklet comprising a spine, a plurality of removable multi-page pamphlets secured at one side to said spine with said pages of each pamphlet being secured together at an opposite side, said pages of each pamphlet being perforated adjacent said one side to permit separation of each pamphlet from the remainder of said pamphlets, at least some of said pamphlets containing identical printed patient information.

2. In combination, a bulk container containing an amount of a prescription drug sufficient for dispensing a plurality of individual prescriptions; and a booklet affixed to said container and including a spine and a plurality of multi-page pamphlets secured at one side to said spine for individual dispensing with a filled prescription, said pages of each pamphlet being secured together at an opposite side and being perforated adjacent said one side to permit separation of each pamphlet from the remainder of said pamphlets with at least some of said pamphlets containing identical printed patient information.

3. In combination, a bulk container containing an amount of a prescription drug sufficient for dispensing a plurality of individual prescriptions; and a booklet affixed to said container and including two or more removable multi-page pamphlets for individual dispensing with a filled prescription, said pamphlets being secured together at one side with said pages of each pamphlet secured together at an opposite side, said pages of each pamphlet being perforated adjacent said one side to permit separation of each pamphlet from the remainder of said pamphlets with at least some of said pamphlets containing identical printed patient information.

4. The combination as set forth in claim 3 wherein one of said pamphlets has a different visual characteristic from the remainder of said pamphlets to define a professional insert while said remainder define patient package inserts.

5. The combination as set forth in claim 4 wherein said booklet includes a front cover disposed over said pamphlets and a back cover affixed to said container.

6. A booklet for attachment to a bulk container for prescription drugs, said booklet comprising two or more removable multi-page pamphlets secured together at one side with said pages of each pamphlet secured together at an opposite side, said pages of each pamphlet being perforated adjacent said one side to permit separation of each pamphlet from the remainder of said pamphlets and with at least some of said pamphlets containing identical printed patient information.

7. A booklet as set forth in claim 6 wherein one of said pamphlets has a different visual characteristic from the remainder of said pamphlets to define a professional insert while said remainder define patient package inserts.

8. A booklet as set forth in claim 7 wherein said professional insert is of a different width from said patient package inserts to define said visual characteristic.

9. A booklet as set forth in claim 6 further including a front cover and a back cover having said removable pamphlets therebetween.

* * * * *